US006595808B2

(12) United States Patent
Prost et al.

(10) Patent No.: US 6,595,808 B2
(45) Date of Patent: Jul. 22, 2003

(54) SPRING INTENDED FOR MAKING AN ELECTRICAL CONNECTION

(75) Inventors: Stephane Prost, Arnas (FR); Franck Da Silva, Saint Savin (FR)

(73) Assignee: Entrelec SA, Lyons (FR)

( * ) Notice: Subject to any disclaimer, the term of this patent is extended or adjusted under 35 U.S.C. 154(b) by 0 days.

(21) Appl. No.: 10/135,697

(22) Filed: May 1, 2002

(65) Prior Publication Data

US 2002/0123274 A1 Sep. 5, 2002

Related U.S. Application Data

(63) Continuation of application No. 09/860,491, filed on May 21, 2001, now abandoned.

(30) Foreign Application Priority Data

May 24, 2000 (FR) ..... 00 06656

(51) Int. Cl.[7] ..... H01R 4/48
(52) U.S. Cl. ..... 439/834
(58) Field of Search ..... 439/834, 835, 439/838, 828, 833, 431, 432, 433, 434, 435, 436

(56) References Cited

U.S. PATENT DOCUMENTS

| | | | |
|---|---|---|---|
| 4,639,060 | A | 1/1987 | Lionnet |
| 5,816,867 | A | 10/1998 | Davidsz et al. |
| 5,860,837 | A | 1/1999 | Bock et al. |
| 5,879,204 | A | 3/1999 | Delarue et al. |
| 6,183,311 | B1 | 2/2001 | Suess et al. |

FOREIGN PATENT DOCUMENTS

| | | |
|---|---|---|
| DE | 1 213 508 | 3/1966 |
| DE | 197 29 327 C1 | 10/1998 |
| EP | 0 303 818 B1 | 2/1989 |
| EP | 0 806 811 A2 | 11/1997 |

*Primary Examiner*—P. Austin Bradley
*Assistant Examiner*—Briggitte R. Hammond
(74) *Attorney, Agent, or Firm*—Oliff & Berridge, PLC

(57) ABSTRACT

This spring is made of an elastic leaf bent in such a way as to exhibit a pressing branch (4) and a moving branch (6) which are connected by an elastic arc (8) to the pressing branch, an opening (18) being made in the moving branch near its free end and being intended to accommodate an end of the conductor that is to be connected.

The opening (18) transversely has a variable width, this width being greater at the end nearest the free end of the moving branch (6).

4 Claims, 1 Drawing Sheet

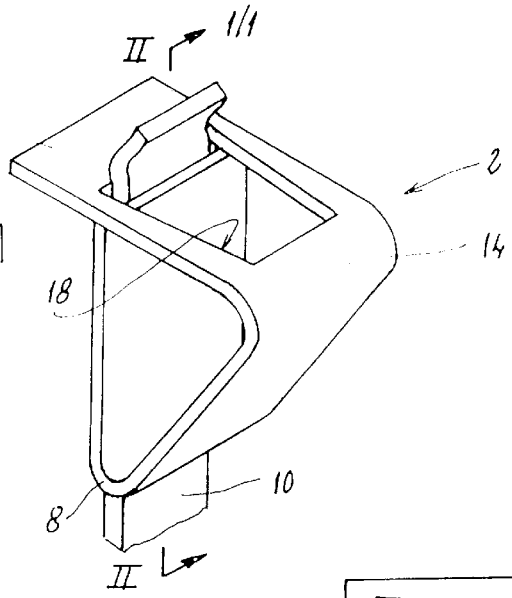
FIG1
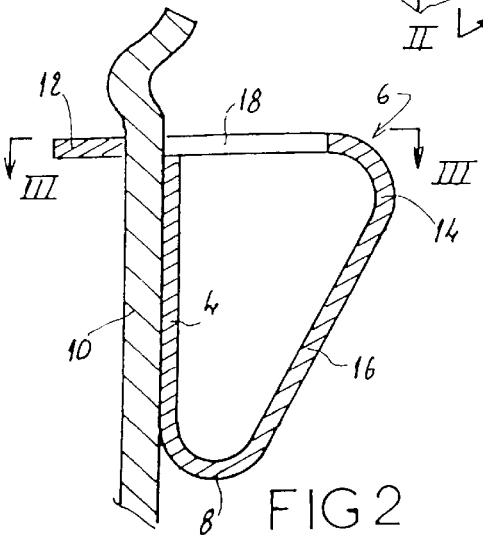
FIG2
FIG3
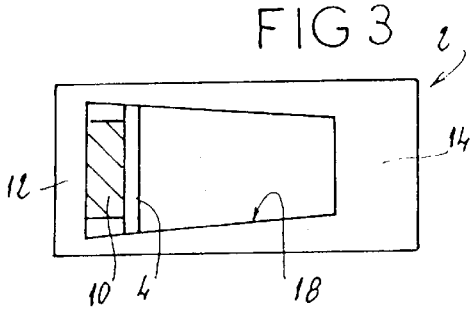
FIG4
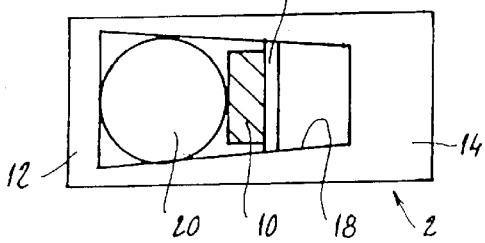
FIG5
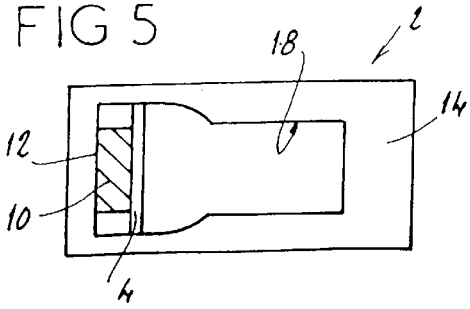
FIG6
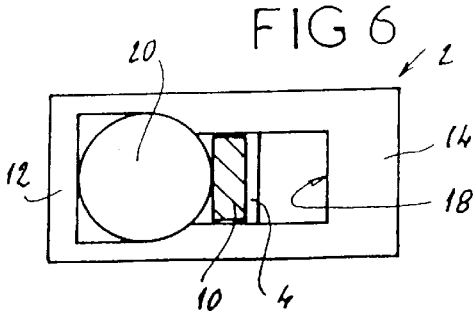

SPRING INTENDED FOR MAKING AN ELECTRICAL CONNECTION

This is a continuation of application Ser. No. 09/860,491 filed May 21, 2001 now Abn. The entire disclosure of the prior application is hereby incorporated by reference herein in its entirety.

The present invention relates to a spring intended especially for making an electrical connection. Such a connecting spring is found, for example, in a connection terminal for an electrical conductor.

It is known practice for springs to be used to hold the end of a stripped conductor against a current-supply rail in a connection terminal. Documents DE-37 27 091 and DE-42 37 733 for example describe connection terminals of this type. These documents disclose a connecting spring made of a flat elastic material and exhibiting the general shape of a loop. The connecting spring has a pressing branch intended to rest against the current supply rail and a gripping branch folded from the rear part of the spring and running more or less transversely to the current supply rail, and also an elastic arc connecting the rear part and the pressing branch together from behind.

A device of this type may also be used for making an insulation-displacement connection of an electrical cable. In this case, the spring is used to store up the energy needed to displace the insulation of an electrical cable and trap it in a connecting slit, and to restore this energy at the appropriate time.

A spring such as this has, on its gripping branch, a window through which the current supply rail passes, and which also accommodates the end from which the insulation has been displaced of a conductor that is to be connected. This conductor is held against the current supply rail, on the opposite side to the side against which the pressing branch rests.

In connecting springs which exist at the present time, this window has a rectangular shape. Its width, which has an influence on the maximum connectable cross section, is constant. In addition, this width is limited by the mechanical integrity of the spring. What happens is that widening the window weakens the gripping branch of this spring.

The object of the present invention is to provide a connecting spring which, for an identical size to that of the springs of the prior art, makes it possible to connect a conductor of larger diameter, while at the same time maintaining good mechanical properties.

To this end, the invention proposes a spring, particularly a connecting spring, made of an elastic leaf bent in such a way as to exhibit a pressing branch and a moving branch which are connected by an elastic arc to the pressing branch, an opening being made in the moving branch near its free end and being intended to accommodate an end of the conductor that is to be connected.

According to the invention, the opening transversely has a variable width, this width being greater at the end nearest the free end of the moving branch.

In this way, it is possible to connect conductors of relatively large diameter. The conductor is therefore introduced at the end where the opening is widest. This widest region, which corresponds to a smaller cross section of material, is made in a region in which the mechanical stresses are not very high when the spring is stressed. Thus, it is possible to provide a width of opening greater than the width of the opening generally made in a connecting spring of the same size in the prior art.

In one preferred embodiment, the opening has an elongate trapezoidal shape. In this case, the large base of the trapezium is of course at the end nearest the free end of the moving branch of the spring.

In another embodiment of a spring according to the invention, the opening exhibits two regions of different widths, connected by a connecting region. A preferred alternative form envisages for the connecting region to have a contour in the form of an arc of a circle and is arranged in such a way that a conductor corresponding to the maximum connectable diameter hugs the contour of the connecting region when it is introduced into the opening. This alternative form of embodiment makes it possible to optimize the mechanical strength of the spring at its moving branch.

In any case, the invention will be clearly understood with the aid of the description which follows, with reference to the appended schematic drawing which, by way of nonlimiting examples, depicts two embodiments of a spring according to the invention.

FIG. 1 is a perspective view of a first embodiment of a spring according to the invention, FIG. 2 is a view in section on the section line II—II of FIG. 1, FIG. 3 is a view in section on the section line III—III of FIG. 2, FIG. 4 corresponds to FIG. 3, a conductor being connected at the connecting spring, FIG. 5 is a view corresponding to FIG. 3, for a second embodiment, and FIG. 6 is a view corresponding to FIG. 4 for the embodiment of FIG. 5.

FIG. 1 shows a spring 2 according to the invention. This spring is intended to make an electrical connection in a connection terminal.

The spring 2 has the shape of a loop and comprises a fixed pressing branch 4 and a moving branch 6. An elastic arc 8 connects the two branches 4 and 6, forming a loop. The spring 2 is made of a strip of flat material, for example a strip of steel sheet.

The fixed branch 4 is intended to press against an electrically-conducting fixed connecting piece such as, for example, the current supply rail 10 depicted in the drawing. In the embodiment depicted, the pressing branch 4 hugs the shape of the current supply rail 10. However, another form of pressing branch or of current supply rail is conceivable.

The moving branch 6 has a bent shape. It comprises a more or less flat first part 12, an elbow 14 and a second part 16.

The flat first part of the moving branch 6 is more or less perpendicular to the pressing branch 4. An opening 18 is made in this first part. It is intended to allow the passage of the end of a conductor that is to be connected and of the current supply rail 10.

The elbow 14 makes a bend in the moving branch by an angle of the order of 90°, the second part 16 of the moving branch 6 connects the elbow 14 to the elastic arc 8.

This then is a shape of spring that can be said to be the classical shape. A similar shape is, for example, already disclosed in documents of the prior art DE-42 37 733, DE-37 27 091 or alternatively EP-0 806 811. The present invention is therefore described with reference to such springs but can also be applied to other springs comprising two branches facing each other.

The present invention relates in particular to the shape of the opening 18. In the embodiment depicted in FIGS. 1 to 4, this opening has the shape of an elongate trapezium. The two bases of the trapezium are perpendicular to the strip of material used to make the spring 2. The long base is at the end nearest the free end of the second part 12 of the moving branch 6.

Thanks to this trapezoidal shape, it becomes possible to connect conductors of larger diameters for a spring according to the invention which has the same dimensions as a spring of the prior art. As the mechanical stresses decrease toward the free end of the moving branch 6, the cross section of the strip of which the spring is made is weakened in a region where the mechanical stresses are not very high when the spring is stressed.

FIG. 3 shows the spring according to the invention in the position of rest. The long base of the opening 18 therefore presses against the current supply rail 10. FIG. 4 shows this spring when a conductor 20 of the maximum connectable diameter is connected. It can be seen in FIG. 4 that the spring 2 holds the conductor 20 against the current supply rail 10, as is achieved conventionally with a connecting spring.

FIGS. 5 and 6 show a second embodiment of the spring 2. Here, only the shape of the opening 18 is altered. In this embodiment, the opening 18 at the end nearest the free end of the first part 12 of the moving branch 6 has a relatively large width corresponding to the maximum diameter of a cable that can be connected in this spring 2. At the opposite end to the free end of the first part 12 of the moving branch 6, the opening 18 has a smaller width. This other end is of more or less rectangular shape. The connection between the wider region of the opening 18 and the narrower region of this opening is via arcs of a circle, the radius of which corresponds to half the maximum diameter of a conductor that can be connected. This connecting zone is arranged in such a way that when a conductor of maximum diameter is introduced into the opening 18, they hug the shape of these connecting regions. FIG. 6 shows the scenario of the connecting of a conductor of maximum size.

As goes without saying, the invention is not restricted to the two embodiments described hereinabove by way of nonlimiting examples: on the contrary, it encompasses all variations within the context of the claims which follow. Thus, other shapes of opening intended to accommodate the current supply rail and the end of the conductor that is to be connected may be imagined.

What is claimed is:

1. A spring made of an elastic leaf bent in such a way as to exhibit a pressing branch (4) and a moving branch (6) which are connected by an elastic arc (8), an opening (18) being made in the moving branch near a free end of the moving branch wherein part of the opening (18) transversely has a variable width that is greater at an end nearest the free end of the moving branch (6), a current supply rail (10) is provided in pressing contact with the pressing branch and includes a portion that extends through the opening and is biased against the free end of the moving branch, the portion having a transverse width sized for travel through at least a portion of the opening to define a conductor receiving opening between the current supply rail and the free end of the moving branch that also has a variable transverse width.

2. The spring according to claim 1, wherein the opening (18) has an elongate trapezoidal shape.

3. The spring according to claim 1, wherein the opening (18) exhibits two regions of different widths, connected by a connecting region.

4. The spring according to claim 3, wherein the connecting region has an arcuate circular contour and when the conductor is of a maximum size and is introduced into the opening, the conductor hugs the contour of the connecting region.

* * * * *